US008690969B2

(12) United States Patent
Sutkowski et al.

(10) Patent No.: US 8,690,969 B2
(45) **Date of Patent: *Apr. 8, 2014**

(54) FUEL OILS

(75) Inventors: Andrew C. Sutkowski, Oxfordshire (GB); Graham Jackson, Berkshire (GB)

(73) Assignee: Infineum International Limited (GB)

( * ) Notice: Subject to any disclaimer, the term of this patent is extended or adjusted under 35 U.S.C. 154(b) by 163 days.

This patent is subject to a terminal disclaimer.

(21) Appl. No.: 11/226,796

(22) Filed: Oct. 27, 2005

(65) Prior Publication Data

US 2006/0059770 A1 Mar. 23, 2006

(30) Foreign Application Priority Data

Sep. 17, 2004 (EP) ..... 04255672

(51) Int. Cl.
*C10L 1/18* (2006.01)

(52) U.S. Cl.
USPC ..... 44/386; 44/400; 44/437

(58) Field of Classification Search
USPC ..... 44/400, 386, 437
See application file for complete search history.

(56) References Cited

U.S. PATENT DOCUMENTS

| | | | | |
|---|---|---|---|---|
| 2,499,367 | A | 3/1950 | De Groote et al. | 252/342 |
| 2,812,342 | A | 11/1957 | Peters | |
| 3,172,892 | A | 3/1965 | Le Suer et al. | |
| 3,216,936 | A | 11/1965 | Le Suer | |
| 3,219,666 | A | 11/1965 | Norman et al. | |
| 3,250,715 | A | 5/1966 | Wyman | |
| 3,260,671 | A | 7/1966 | Trites et al. | |
| 3,272,746 | A | 9/1966 | Le Suer et al. | |
| 3,310,492 | A | 3/1967 | Benoit, Jr. | |
| 3,341,542 | A | 9/1967 | Le Suer et al. | |
| 3,444,170 | A | 5/1969 | Norman et al. | |
| 3,455,831 | A | 7/1969 | Davis | |
| 3,455,832 | A | 7/1969 | Davis | |
| 3,576,743 | A | 4/1971 | Widmer et al. | |
| 3,630,904 | A | 12/1971 | Musser et al. | |
| 3,632,511 | A | 1/1972 | Liao | |
| 3,804,763 | A | 4/1974 | Meinhardt | |
| 3,912,764 | A | 10/1975 | Palmer, Jr. | |
| 3,961,916 | A | 6/1976 | Ilnyckyj et al. | |
| 4,147,520 | A | 4/1979 | Ilnyckyj | |
| 4,211,534 | A | 7/1980 | Feldman | |
| 4,234,435 | A | 11/1980 | Meinhardt et al. | |
| 4,356,002 | A | 10/1982 | Knepper et al. | 44/62 |

(Continued)

FOREIGN PATENT DOCUMENTS

| | | |
|---|---|---|
| EP | 0061895 | 11/1981 |
| EP | 117108 | 8/1984 |

(Continued)

OTHER PUBLICATIONS

Platé, N. A. et al: "Comb-Like Polymers, Structure and Properties," J. Poly. Sci. Macromolecular Revs., 8, pp. 117-253 (1974).

*Primary Examiner* — Ellen McAvoy
*Assistant Examiner* — Latosha Hines
(74) *Attorney, Agent, or Firm* — Kenyon and Kenyon LLP

(57) ABSTRACT

The use of an additive composition to improve the conductivity of a fuel oil. The additive composition comprises a polymeric condensation product formed by the reaction of an aliphatic aldehyde or ketone, or a reactive equivalent, with at least one ester of p-hydroxybenzoic acid.

9 Claims, 4 Drawing Sheets

(56) References Cited

U.S. PATENT DOCUMENTS

| | | | | |
|---|---|---|---|---|
| 4,491,455 | A | 1/1985 | Ishizaki et al. | |
| 4,832,702 | A | 5/1989 | Kummer et al. | |
| 5,621,154 | A | 4/1997 | Wright et al. | |
| 7,713,315 | B2 * | 5/2010 | Krull et al. | 44/351 |
| 2002/0107153 | A1 | 8/2002 | Taylor et al. | 508/479 |
| 2004/0060227 | A1 * | 4/2004 | Jackson et al. | 44/400 |
| 2005/0000151 | A1 * | 1/2005 | Jackson | 44/386 |

FOREIGN PATENT DOCUMENTS

| | | | | |
|---|---|---|---|---|
| EP | 153176 | | 8/1985 | |
| EP | 153177 | | 8/1985 | |
| EP | 156577 | | 10/1985 | |
| EP | 225688 | | 9/1986 | |
| EP | 213879 | | 3/1987 | |
| EP | 214786 | | 3/1987 | |
| EP | 244616 | | 3/1987 | |
| EP | 0263703 | | 4/1988 | |
| EP | 282342 | | 9/1988 | |
| EP | 326356 | | 8/1989 | |
| EP | 327427 | | 8/1989 | |
| EP | 0336664 | | 10/1989 | |
| EP | 0451380 | | 10/1991 | |
| EP | 0807676 | | 11/1997 | |
| EP | 1357168 | | 4/2002 | |
| EP | 1314771 | | 11/2002 | |
| EP | 1 357 169 | A2 | 10/2003 | C10L 1/18 |
| EP | 1357169 | | 10/2003 | |
| EP | 1482064 | | 12/2004 | |
| EP | 04252799 | | 12/2004 | |
| FR | 1258027 | | 5/1960 | |
| GB | 1440219 | | 6/1976 | |
| JP | 2-51477 | | 2/1990 | |
| JP | 3-34790 | | 2/1991 | |
| JP | 2004-501226 | | 1/2004 | |
| JP | 2004-352993 | | 12/2004 | |
| KR | 1020020086956 | | 11/2002 | |
| KR | 1020040103331 | | 12/2004 | |
| WO | 91/16407 | | 10/1991 | |
| WO | 93/04148 | | 3/1993 | |
| WO | 93/19106 | | 9/1993 | |
| WO | 94/07842 | | 4/1994 | |
| WO | 94/17160 | | 8/1994 | |
| WO | 97/45507 | | 12/1997 | |
| WO | 98/28346 | | 7/1998 | |
| WO | 99/15607 | | 4/1999 | |
| WO | WO01/88064 | A2 | 11/2001 | C10L 1/00 |
| WO | 02/02720 | | 1/2002 | |
| WO | 03/106595 | | 12/2003 | |

* cited by examiner

FUEL OILS

This invention relates to the use of an additive composition to improve the conductivity characteristics of fuel oils.

A consequence of refining processes employed to reduce diesel fuel sulphur and aromatic contents is a reduction in the electrical conductivity of the fuel. The insulating properties of low sulphur fuels represent a potential hazard to refiners, distributors and customers due to the potential for static charge accumulation and discharge. Static charges can occur during pumping and especially filtration of the fuel, the release of this charge accumulation as a spark constituting a significant risk in highly flammable environments. Such risks are minimised during fuel processing and handling through appropriate earthing of fuel lines and tanks combined with the use of anti-static additives. These anti-static additives do not prevent the accumulation of static charges but enhance their release to the earthed fuel lines and vessels thereby controlling the risk of sparking.

Alkyl phenol formaldehyde condensates (APFC) are known as additives for fuel oils to improve low temperature characteristics. As such, they can be used to extend the operability range of fuels such as jet fuels, which routinely experience low temperatures in use. Reference can be made to EP 1357169, EP 1357168 and EP 13114771.

A condensate species derived from an alkyl ester of hydroxybenzoic acid, (HydroxyBenzoate-Formaldehyde Condensates) referred to herein as HBFC, also improves the low temperature characteristics of fuel oils. This material is the subject of the present applicant's co-pending application EP 04252799.4.

The present invention is based on the finding that HBFC materials can be used to significantly improve the conductivity of fuel oils. An advantage of the present invention is thus that the HBFC materials perform a dual function; both the conductivity and the low temperature characteristics of a fuel oil are improved.

The Applicants have also found that there is a significant synergistic effect on the conductivity of fuel oils when HBFC materials are used in combination with other co-additives. This effect extends to co-additives which themselves have little or no inherent conductivity.

In accordance with a first aspect of the present invention there is provided the use of an additive composition to improve the conductivity of a fuel oil; wherein the additive composition comprises a polymeric condensation product formed by the reaction of an aliphatic aldehyde or ketone, or a reactive equivalent, with at least one ester of p-hydroxybenzoic acid.

Preferably, the at least one ester of p-hydroxybenzoic acid comprises; (i) a straight or branched chain $C_1$-$C_7$ alkyl ester of p-hydroxybenzoic acid; (ii) a branched chain $C_8$-$C_{16}$ alkyl ester of p-hydroxybenzoic acid, or; (iii) a mixture of long chain $C_8$-$C_{18}$ alkyl esters of p-hydroxybenzoic acid, at least one of said alkyls being branched.

Preferably, the alkyl in (i) is ethyl or n-butyl.

Preferably, the branched alkyl group in (ii) is 2-ethylhexyl or isodecyl.

Generally speaking, the molar ratio of the branched ester to the other ester may be in the range of 5:1 to 1:5.

Condensates of mixed esters may be used, for example mixed ester condensates of n-octyl and 2-ethylhexyl esters of p-hydroxybenzoic acid may be prepared. The ratio of the esters in the mixed condensates may be varied as required. A mixed ester condensate where the molar ratio of 2-ethylhexyl ester to n-octyl ester is 3:1 has been found to be useful. Mixed ester condensates of more than two ester monomers may also be prepared.

The number average molecular weight of the polymeric condensation products is suitably in the range of 500 to 5000, preferably 1000 to 3000, more preferably 1000 to 2000 Mn.

Other comonomers may be added to the reaction mixture of aldehyde and alkyl ester or mixture of alkyl esters. Some of the polymers described above, for example, that are based on the 2-ethylhexyl ester, are too viscous to be handled conveniently at temperatures they would be used commercially, i.e. ambient to 60° C., unless diluted with a large proportion of solvent. This problem can be overcome by replacing up to 33 mole % of the p-hydroxybenzoic ester or ester mixture used in the condensation reaction with other comonomers in order to modify the physical properties of the polymers whilst still retaining activity. The comonomers are aromatic compounds that are sufficiently reactive to take part in the condensation reaction. They include alkylated, arylated and acylated benzenes such as toluene, xylene, mesitylene, biphenyls and acetophenone. Other comonomers include hydroxy aromatic compounds such as p-hydroxybenzoic acid, acid derivatives of p-hydroxyaromatic acids such as amides and salts, other hydroxyaromatic acids, alkylphenols, naphthols, phenylphenols, acetamidophenols, alkoxyphenols and o-alkylated, o-arylated and o-acylated phenols. The hydroxy compounds should be either di- or mono-functional with regard to the condensation reaction. The hydroxy compounds that are difunctional should be substituted in the para-position whilst those that are mono-functional can be substituted in any position, e.g. 2,4-di-t-butylphenol these will only incorporate at the end of a polymer chain.

HBFC may be prepared by the reaction between one or more aldehydes or ketones or reactive equivalents with esters of p-hydroxybenzoic acid. The term "reactive equivalent" means a material that generates an aldehyde under the conditions of the condensation reaction or a material that undergoes the required condensation reaction to produce moieties equivalent to those produced by an aldehyde. Typical reactive equivalents include oligomers or polymers of the aldehyde, acetals or aldehyde solutions.

The aldehyde may be a mono- or di-aldehyde and may contain other functional groups, such as —COOH, and these could be capable of post-reactions in the product. The aldehyde or ketone or reactive equivalent preferably contains 1-8 carbon atoms, particularly preferred are formaldehyde, acetaldehyde, propionaldehyde and butyraldehyde, most preferred is formaldehyde. Formaldehyde could be in the form of paraformaldehyde, trioxan or formalin.

HBFC are prepared by reacting 1 molecular equivalent (M.E.) of the esters of p-hydroxybenzoic acid with about 0.5-2 M.E. of the aldehyde, preferably 0.7-1.3 M.E. and more preferably 0.8-1.2 M.E. of the aldehyde. The reaction is preferably conducted in the presence of a basic or acidic catalyst, more preferably an acidic catalyst, such as p-toluenesulphonic acid. The reaction is conveniently conducted in an inert solvent, such as Exxsol D60 (a non-aromatic, hydrocarbon solvent, having a boiling point of ~200° C.), the water produced in the reaction being removed by azeotropic distillation. The reaction is typically run at a temperature of 90-200° C., preferably 100-160° C., and may be run under reduced pressure.

Conveniently, the HBFC can be prepared in a 2-step process whereby the esters of p-hydroxybenzoic acid are first prepared in the same reaction vessel that is used for the subsequent condensation reaction. Thus, the ester is prepared from the appropriate alcohol and p-hydroxybenzoic acid in an inert solvent using an acid catalyst such as p-toluenesulphonic acid, continuously removing water produced in the reaction. Formaldehyde is then added and the condensation reaction conducted as described above to give the desired HBFC.

Preferably, the additive composition further comprises at least one of the co-additives defined as (a)-(i) hereinbelow. A number of these co-additives have little or no inherent conductivity. Unexpectedly, their use in combination with HBFC materials provides a fuel oil with conductivity greater than that which would be expected from a simple summation of the conductivity effect of each additive taken alone.

In a preferred embodiment, the additive composition further comprises a co-additive defined as (f) hereinbelow. In this embodiment, it is particularly preferred that the branched alkyl group of the polymeric condensation product is isodecyl.

In a further preferred embodiment, the additive composition further comprises a co-additive defined as (i) hereinbelow.

Preferably, the ratio of the amount of the polymeric condensation product to the amount of co-additive in the additive composition is between 9:1 to 1:9, more preferably between 6:1 to 1:6, for example between 4:1 to 1:4, 3:1 to 1:3, 2:1 to 1:2 or 1:1, based on the molar amounts of active ingredients.

In accordance with a second aspect, the present invention provides a method for improving the conductivity of a fuel oil, the method comprising adding to a fuel oil, a minor amount of an additive composition as defined hereinabove.

In accordance with a third aspect, the present invention provides a method for simultaneously improving both the conductivity and cold flow characteristics of a fuel oil, the method comprising adding to a fuel oil, a minor amount of an additive composition as defined hereinabove. This leads to a simplification of formulation activities, reduces the number of components required and avoids the potential for negative component interactions.

In accordance with a fourth aspect, the present invention provides a conductivity improving additive composition, the composition comprising:

(A) a polymeric condensation product as defined in relation to the first aspect; and a co-additive defined as (f) hereinbelow which is one or both of, (B) a copolymer, terpolymer or polymer of acrylic acid or methacrylic acid which has been copolymerized with a nitrogen-containing, amine-containing or amide-containing monomer;

(C) a copolymer, terpolymer or polymer of acrylic acid or methacrylic acid or derivative thereof which includes nitrogen-containing, amine-containing or amide-containing branches; or, (D) an ester of a polyalkenylthiophosphonic acid.

Preferably, the branched alkyl group of the polymeric condensation product is 2-ethylhexyl or isodecyl, more preferably 2-ethylhexyl.

In accordance with a fifth aspect, the present invention provides a fuel composition comprising a major amount of a fuel oil and a minor amount of the conductivity improving additive composition of the fourth aspect.

The fuel oil may be, e.g., a petroleum-based fuel oil, especially a middle distillate fuel oil. Such distillate fuel oils generally boil within the range of from 110° C. to 500° C., e.g. 150° C. to 400° C.

The invention is applicable to middle distillate fuel oils of all types, including the broad-boiling distillates, i.e., those having a 90%-20% boiling temperature difference, as measured in accordance with ASTM D-86, of 50° C. or more.

The fuel oil may comprise atmospheric distillate or vacuum distillate, cracked gas oil, or a blend in any proportion of straight run and thermally and/or catalytically cracked distillates. The most common petroleum distillate fuels are kerosene, jet fuels, diesel fuels, heating oils and heavy fuel oils. The heating oil may be a straight atmospheric distillate, or may also contain vacuum gas oil or cracked gas oil or both. The fuels may also contain major or minor amounts of components derived from the Fischer-Tropsch process. Fischer-Tropsch fuels, also known as FT fuels, include those that are described as gas-to-liquid fuels, coal and/or biomass conversion fuels. To make such fuels, syngas ($CO+H_2$) is first generated and then converted to normal paraffins and olefins by a Fischer-Tropsch process. The normal paraffins may then be modified by processes such as catalytic cracking/reforming or isomerisation, hydrocracking and hydroisomerisation to yield a variety of hydrocarbons such as iso-paraffins, cyclo-paraffins and aromatic compounds. The resulting FT fuel can be used as such or in combination with other fuel components and fuel types such as those mentioned in this specification. The above mentioned low temperature flow problem is most usually encountered with diesel fuels and with heating oils. The invention is also applicable to fuel oils containing fatty acid methyl esters derived from vegetable oils, for example, rapeseed methyl ester, either used alone or in admixture with a petroleum distillate oil.

The invention is particularly useful for the formulation of turbine combustion fuel oils which are generally those hydrocarbon fuels having boiling ranges within the limits of about 150° to 600° F. (65 to 315° C.) and are designated by such terms as JP-4, JP-5, JP-7, JP-8, Jet A, Jet A-1. JP4 and JP-5 are fuels defined by U.S. military specification MIL-T-5624-N and JP-8 is defined by U.S. Military Specification MIL-T83133-D. Jet A, Jet A-1 and Jet B are defined by ASTM specification D1655.

The fuel oil is preferably a low sulphur content fuel oil. Typically, the sulphur content of the fuel oil will be less than 500 ppm (parts per million by weight). Preferably, the sulphur content of the fuel will be less than 100 ppm, for example, less than 50 ppm. Fuel oils with even lower sulphur contents, for example less that 20 ppm or less than 10 ppm are also suitable. As outlined above, it is with these low sulphur fuels that problems with low inherent conductivity are more commonly experienced.

The concentration of the polymeric condensation product in the oil is from 0.1 to 10,000 ppm, preferably in the range of 1 to 1,000 ppm (active ingredient) by weight per weight of fuel, preferably 1 to 500 ppm, more preferably 1 to 100 ppm.

The polymeric condensation product, and any co-additive, may be incorporated into bulk oil by methods such as those known in the art. Where more than one additive component or co-additive component is to be used, such components may be incorporated into the oil together or separately in any combination.

A concentrate comprising the polymeric condensation product dispersed in carrier liquid (e.g. in solution) is convenient as a means of incorporating the polymeric condensation product. The concentrates of the present invention are convenient as a means for incorporating the polymeric condensation product into bulk oil such as distillate fuel, which incorporation may be done by methods known in the art. The concentrates may also contain other additives as required and preferably contain from 3 to 75 wt. %, more preferably 3 to 60 wt. %, most preferably 10 to 50 wt. % of the polymeric condensation product preferably in solution in oil. Examples of carrier liquid are organic solvents including hydrocarbon solvents, for example petroleum fractions such as naphtha, kerosene, diesel and heater oil; aromatic hydrocarbons such as aromatic fractions, e.g. those sold under the 'SOLVESSO' tradename; alcohols and/or esters; and paraffinic hydrocarbons such as hexane and pentane and isoparaffins. Alkylphenols, such as nonylphenol and 2,4-di-t-butylphenol either alone or in combination with any of the above, have also been found to be particularly useful as carrier solvents. The carrier liquid must, of course, be selected having regard to its compatibility with the polymeric condensation product, any co-additive, and with the fuel.

(a) Ethylene Polymers

Each polymer may be a homopolymer or a copolymer of ethylene with another unsaturated monomer. Suitable co-monomers include hydrocarbon monomers such as propylene, n- and iso-butylenes, 1-hexene, 1-octene, methyl-1-pentene vinyl-cyclohexane and the various alpha-olefins known in the art, such as 1-decene, 1-dodecene, 1-tetradecene, 1-hexadecane and 1-octadecene and mixtures thereof.

Preferred co-monomers are unsaturated esters or ether monomers, with ester monomers being more preferred. Preferred ethylene unsaturated ester copolymers have, in addition to units derived from ethylene, units of the formula:

$$—CR^1R^2—CHR^3—$$

wherein $R^1$ represents hydrogen or methyl, $R^2$ represents $COOR^4$, wherein $R^4$ represents an alkyl group having from 1-12, preferably 1-9 carbon atoms, which is straight chain, or, if it contains 3 or more carbon atoms, branched, or $R^2$ represents $OOCR^5$, wherein $R^5$ represents $R^4$ or H, and $R^3$ represents H or $COOR^4$.

These may comprise a copolymer of ethylene with an ethylenically unsaturated ester, or derivatives thereof. An example is a copolymer of ethylene with an ester of a saturated alcohol and an unsaturated carboxylic acid, but preferably the ester is one of an unsaturated alcohol with a saturated carboxylic acid. An ethylene-vinyl ester copolymer is advantageous; an ethylene-vinyl acetate, ethylene-vinyl propionate, ethylene-vinyl hexanoate, ethylene-vinyl 2-ethylhexanoate, ethylene-vinyl octanoate or ethylene-vinyl versatate copolymer is preferred. Preferably, the copolymer contains from 5 to 40 wt % of the vinyl ester, more preferably from 10 to 35 wt % vinyl ester. A mixture of two copolymers, for example, as described in U.S. Pat. No. 3,961,916, may be used. The Mn of the copolymer is advantageously 1,000 to 10,000. If desired, the copolymer may contain units derived from additional comonomers, e.g. a terpolymer, tetrapolymer or a higher polymer, e.g. where the additional comonomer is isobutylene or diisobutylene or a further unsaturated ester.

(b) Comb Polymers

Comb polymers are discussed in "Comb-Like Polymers. Structure and Properties", N. A. Plate and V. P. Shibaev, J. Poly. Sci. Macromolecular Revs., 8, p 117 to 253 (1974).

Generally, comb polymers consist of molecules in which long chain branches such as hydrocarbyl branches, optionally interrupted with one or more oxygen atoms and/or carbonyl groups, having from 6 to 30 such as 10 to 20, carbon atoms, are pendant from a polymer backbone, said branches being bonded directly or indirectly to the backbone. Examples of indirect bonding include bonding via interposed atoms or groups, which bonding can include covalent and/or electrovalent bonding such as in a salt. Generally, comb polymers are distinguished by having a minimum molar proportion of units containing such long chain branches.

As examples of preferred comb polymers there may be mentioned those containing units of the general formula $$—(CDE\text{-}CHG)_m(CJK\text{-}CHL)_n—$$

where

D represents $R^{11}$, $COOR^{10}$, $OCOR^{10}$, $R^{11}COOR^{10}$ or $OR^{10}$;

E represents H or D;

G represents H or D;

J represents H, $R^{11}$, $R^{11}COOR^{10}$, or a substituted or unsubstituted aryl or heterocyclic group;

K represents H, $COOR^{11}$, $OCOR^{11}$, $OR^{11}$ or COOH;

L represents H, $R^{11}$, $COOR^{11}$, $OCOR^{11}$ or substituted or unsubstituted aryl;

$R^{10}$ representing a hydrocarbyl group having 10 or more carbon atoms, and $R^{11}$ representing a hydrocarbylene (divalent) group in the $R^{11}COOR^{10}$ moiety and otherwise a hydrocarbyl (monovalent) group, and m and n represent mole ratios, their sum being 1 and m being finite and being up to and including 1 and n being from zero to less than 1, preferably m being within the range of from 1.0 to 0.4 and n being in the range of from 0 to 0.6. $R^{10}$ advantageously represents a hydrocarbyl group with from 10 to 30 carbon atoms, preferably 10 to 24, more preferably 10 to 18. Preferably, $R^{10}$ is a linear or slightly branched alkyl group and $R^{11}$ advantageously represents a hydrocarbyl group with from 1 to 30 carbon atoms when monovalent, preferably with 6 or greater, more preferably 10 or greater, preferably up to 24, more preferably up to 18 carbon atoms. Preferably, $R^{11}$, when monovalent, is a linear or slightly branched alkyl group. When $R^{11}$ is divalent, it is preferably a methylene or ethylene group. By "slightly branched" is meant having a single methyl branch.

The comb polymer may contain units derived from other monomers if desired or required, examples being CO, vinyl acetate and ethylene. It is within the scope of the invention to include two or more different comb copolymers.

The comb polymers may, for example, be copolymers of maleic anhydride acid and another ethylenically unsaturated monomer, e.g. an α-olefin or an unsaturated ester, for example, vinyl acetate as described in EP-A-214,786. It is preferred but not essential that equimolar amounts of the comonomers be used although molar proportions in the range of 2 to 1 and 1 to 2 are suitable. Examples of olefins that may be copolymerized with e.g. maleic anhydride, include 1-decene, 1-dodecene, 1-tetradecene, 1-hexadecene, 1-octadecene, and styrene. Other examples of comb polymers include polyalkyl(meth)acrylates.

Copolymer may be esterified by any suitable technique and although preferred it is not essential that the maleic anhydride or fumaric acid be at least 50% esterified. Examples of alcohols that may be used include n-decan-1-ol, n-dodecan-1-ol, n-tetradecan-1-ol, n-hexadecan-1-ol, and n-octadecan-1-ol. The alcohols may also include up to one methyl branch per chain, for example, 2-methylpentadecan-1-ol, 2-methyltridecan-1-ol as described in EP-A-213,879. The alcohol may be a mixture of normal and single methyl branched alcohols. It is preferred to use pure alcohols rather than alcohol mixtures such as may be commercially available; if mixtures are used, the number of carbon atoms in the alkyl group is taken to be the average number of carbon atoms in the alkyl groups of the alcohol mixture; if alcohols that contain a branch at the 1 or 2 positions are used, the number of carbon atoms in the alkyl group is taken to be the number in the straight chain backbone segment of the alkyl group of the alcohol.

The copolymer may also be reacted with a primary and/or secondary amine, for example, a mono- or di-hydrogenated tallow amine.

The comb polymers may especially be fumarate or itaconate polymers and copolymers such as for example those described in European Patent Applications 153 176, 153 177, 156 577 and 225 688, and WO 91/16407. The comb polymers are preferably $C_8$ to $C_{12}$ dialkylfumarate-vinyl acetate copolymers.

Other suitable comb polymers are the polymers and copolymers of α-olefins and esterified copolymers of styrene and maleic anhydride, and esterified copolymers of styrene and fumaric acid as described in EP-A-282,342; mixtures of two or more comb polymers may be used in accordance with the invention and, as indicated above, such use may be advantageous.

Other examples of comb polymers are hydrocarbon polymers such as copolymers of at least one short chain 1-alkene and at least one long chain 1-alkene. The short chain 1-alkene is preferably a $C_3$-$C_8$ 1-alkene, more preferably a $C_4$-$C_6$ 1-alkene. The long chain 1-alkene preferably includes greater than 8 carbon atoms and at most 20 carbon atoms. The long chain 1-alkene is preferably a $C_{10}$-$C_{14}$ 1-alkene, including 1-decene, 1-dodecene and 1-tetradecene (see, for example, WO 93/19106). The comb polymer is preferably a copolymer of at least one 1-dodecene and at least one 1-butene in the ratio of 60-90 mole % 1-dodecene to 40-10 mole % 1-butene, preferably in the ratio of 75-85 mole % 1-dodecene to 25-15 mole % 1-butene. Preferably, the comb polymer is a mixture of two or more comb polymers made from a mixture of two or more 1-alkenes. Preferably, the number average molecular weight measured by Gel Permeation Chromatography against polystyrene standards of such a copolymer is, for example, up to 20,000 or up to 40,000, preferably from 4,000 to 10,000, preferably 4,000 to 6,000. The hydrocarbon copolymers may be prepared by methods known in the art, for example using a Ziegler-Natta type, Lewis acid or metallocene catalyst.

(c) Polar Nitrogen Compounds

Such compounds are oil-soluble polar nitrogen compounds carrying one or more, preferably two or more, substituents of the formula $>NR^{13}$, where $R^{13}$ represents a hydrocarbyl group containing 8 to 40 atoms, which substituent or one or more of which substituents may be in the form of a cation derived therefrom. The oil soluble polar nitrogen compound is generally one capable of acting as a wax crystal growth inhibitor in fuels. It comprises for example one or more of the following compounds:

An amine salt and/or amide formed by reacting at least one molar proportion of a hydrocarbyl-substituted amine with a molar proportion of a hydrocarbyl acid having from 1 to 4 carboxylic acid groups or its anhydride, the substituent(s) of formula $>NR^{13}$ being of the formula $—NR^{13}R^{14}$ where $R^{13}$ is defined as above and $R^{14}$ represents hydrogen or $R^{13}$, provided that $R^{13}$, and $R^{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211,534. Suitable amines are predominantly $C_{12}$ to $C_{40}$ primary, secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include di-octadecylamine, di-cocoamine, di-hydrogenated tallow amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic acid, and carboxylic acids based on cyclic skeletons, e.g., cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids, e.g. phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine. Another preferred compound is the diamide formed by dehydrating this amide-amine salt.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates, for example, those described in EP-A-327427.

Other examples of polar nitrogen compounds are compounds containing a ring system carrying at least two substituents of the general formula below on the ring system $$-A-NR^{15}R^{16}$$

where A is a linear or branched chain aliphatic hydrocarbylene group optionally interrupted by one or more hetero atoms, and $R^{15}$ and $R^{16}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or polymethylene group. Such compounds are described in WO 93/04148 and WO9407842.

Other examples are the free amines themselves as these are also capable of acting as wax crystal growth inhibitors in fuels. Suitable amines including primary, secondary, tertiary or quaternary, but are preferably secondary. Examples of amines include tetradecylamine, cocoamine, and hydrogenated tallow amine. Examples of secondary amines include di-octadecylamine, di-cocoamine, di-hydrogenated tallow amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

(d) Polyoxyalkylene Compounds

Examples are polyoxyalkylene esters, ethers, ester/ethers and mixtures thereof, particularly those containing at least one, preferably at least two, $C_{10}$ to $C_{30}$ linear alkyl groups and a polyoxyalkylene glycol group of molecular weight up to 5,000, preferably 200 to 5,000, the alkyl group in said polyoxyalkylene glycol containing from 1 to 4 carbon atoms. These materials form the subject of EP-A-0061895. Other such additives are described in U.S. Pat. No. 4,491,455.

The preferred esters, ethers or ester/ethers are those of the general formula $$R^{31}—O(D)-O—R^{32}$$

where $R^{31}$ and $R^{32}$ may be the same or different and represent (a) n-alkyl- (b) n-alkyl-CO—

(c) n-alkyl-O—$CO(CH_2)_n$— or (d) n-alkyl-O—$CO(CH_2)_n$—CO— x being, for example, 1 to 30, the alkyl group being linear and containing from 10 to 30 carbon atoms, and D representing the polyalkylene segment of the glycol in which the alkylene group has 1 to 4 carbon atoms, such as a polyoxymethylene, polyoxyethylene or polyoxytrimethylene moiety which is substantially linear; some degree of branching with lower alkyl side chains (such as in polyoxypropylene glycol) may be present but it is preferred that the glycol is substantially linear. D may also contain nitrogen.

Examples of suitable glycols are substantially linear polyethylene glycols (PEG) and polypropylene glycols (PPG) having a molecular weight of from 100 to 5,000, preferably from 200 to 2,000. Esters are preferred and fatty acids containing from 10-30 carbon atoms are useful for reacting with the glycols to form the ester additives, it being preferred to use a $C_{18}$-$C_{24}$ fatty acid, especially behenic acid. The esters may also be prepared by esterifying polyethoxylated fatty acids or polyethoxylated alcohols.

These materials may also be prepared by alkoxylation of a fatty acid ester of a polyol (e.g. ethoxylated sorbitan tristearate having the trade name TWEEN 65, which is available from Uniqema).

Polyoxyalkylene diesters, diethers, ether/esters and mixtures thereof are suitable as additives, diesters being preferred for use in narrow boiling distillates, when minor amounts of monoethers and monoesters (which are often formed in the manufacturing process) may also be present. It is preferred that a major amount of the dialkyl compound be present. In particular, stearic or behenic diesters of polyethylene glycol, polypropylene glycol or polyethylene/polypropylene glycol mixtures are preferred.

Other examples of polyoxyalkylene compounds are those described in Japanese Patent Publication Nos. 2-51477 and 3-34790, and the esterified alkoxylated amines described in EP-A-117108 and EP-A-326356.

(e) Di-Block Hydrocarbon Polymers

These polymers may be an oil-soluble hydrogenated block diene polymer comprising at least one crystallizable block, obtainable by ene-to-end polymerization of a linear diene, and at least one non-crystallizable block being obtainable by 1,2-configuration polymerization of a linear diene, by polymerization of a branched diene, or by a mixture of such polymerizations.

Advantageously, the block copolymer before hydrogenation comprises units derived from butadiene only, or from butadiene and at least one comonomer of the formula $$CH_2{=}CR^{20}—CR^{21}{=}CH_2$$

wherein $R^{20}$ represents a $C_1$ to $C_8$ alkyl group and $R^{21}$ represents hydrogen or a $C_1$ to $C_8$ alkyl group. Advantageously, the total number of carbon atoms in the comonomer is 5 to 8, and the comonomer is advantageously isoprene. Advantageously, the copolymer contains at least 10% by weight of units derived from butadiene.

(f) Copolymer, Terpolymer or Polymer of Acrylic Acid or Methacrylic Acid or a Derivative Thereof.

The copolymers, terpolymers and polymers of acrylic acid or methacrylic acid or a derivative thereof may be branched or linear. Suitable copolymers, terpolymers or polymers of acrylic acid or methacrylic acid or derivatives thereof are those polymers of ethylenically unsaturated monomers such as methacrylic or acrylic acid esters of alcohols having about 1 to 40 carbon atoms, such as methylacrylate, ethylacrylate, n-propylacrylate, lauryl acrylate, stearyl acrylate, methylmethacrylate, ethylmethacrylate, n-propylmethacrylate, lauryl methacrylate, stearyl methacrylate, isodecylmethacrylate, 2-ethylhexylmethacrylate and the like. These copolymers, terpolymers and polymers may have number average molecular weights (Mn) of 1,000 to 10,000,000 and preferably the molecular weight range is from about 5,000 to 1,000,000, most preferably 5,000 to 100,000. A mixture of copolymers, terpolymers and polymers of acrylic acid or methacrylic acid may also be used.

In a preferred embodiment, the acrylate or methacrylate monomer or derivative thereof is copolymerized with a nitrogen-containing, amine-containing or amide-containing monomer, or the acrylate or methacrylate main chain polymer is provided so as to contain sites suitable for grafting, and then nitrogen-containing, amine-containing or amide-containing branches, either monomers or macromonomers, are grafted onto the main chain. Transesterification reactions or amidation reactions may also be employed to produce the same products. Preferably, the copolymer, terpolymer or polymer will contain 0.01 to 5 wt. % nitrogen, more preferably 0.02 to 1 wt. % nitrogen, even more preferably 0.04 to 0.15 wt. % nitrogen.

Examples of amine-containing monomers include: the basic amino substituted olefins such as p-(2-diethylaminoethyl) styrene; basic nitrogen-containing heterocycles having a polymerizable ethylenically unsaturated substituent, such as the vinyl pyridines or the vinyl pyrrolidones; esters of amino alcohols with unsaturated carboxylic acids such as dimethylaminoethyl methacrylate, diethylaminoethyl methacrylate, tertiary butylaminoethyl methacrylate or dimethylaminopropyl methacrylate; amides of diamines with unsaturated carboxylic acids, such as dimethylaminopropyl methacrylamide; amides of polyamines with unsaturated carboxylic acids, examples of such polyamines being ethylene diamine (EDA), diethylene triamine (DETA), triethylene tetramine (TETA), tetraethylene pentamine (TEPA), pentaethylene hexamine (PEHA), and higher polyamines, PAM (N=7,8) and Heavy Polyamine (N>8); morpholine derivatives of unsaturated carboxylic acids, such as N-(aminopropyl)morpholine derivatives; and polymerizable unsaturated basic amines such as allyl amine.

Particularly preferred is a copolymer of a methacrylate ester of a $C_8$-$C_{14}$ alcohol with a methacrylate ester of an N,N-dialkylaminoalkyl alcohol, such as N,N dimethyl-2-aminoethanol.

(g) Nitrogen-Containing Ashless Detergent

One class of nitrogen containing ashless detergents comprises an acylated nitrogen compound, preferably having a hydrocarbyl substituent of at least 10 aliphatic carbon atoms, made by reacting a carboxylic acid acylating agent with at least one amine compound containing at least one —NH-group, said acylating agent being linked to said amino compound through an imido, amido, amidine or acyloxy ammonium linkage, the ratio of hydrocarbyl units to amine units being 1:1 to 2.5:1, preferably 1.2:1 to 1.5:1.

Another class of nitrogen containing ashless detergents comprises the "polyalkylene amines". These are derived from polyalkylenes of greater than 250 mass units, which are themselves preferably derived from $C_2$-$C_{10}$ alkenes and more preferably from butene and/or isobutene. They are prepared by linking ammonia, amines, polyamines, alkylamines or alkanolamines to and/or between these polymers. A variety of methods can be used to achieve this, for example routes via chlorination, hydroformylation, epoxidation and ozonolysis are known in the art. Typical examples, which are also well known in the art, are polyisobutene monoamine ("PIBA") and polyisobutene-ethylenediamine ("PIB-EDA"). Further examples are described in EP 244616 and WO 98/28346. The ratio of hydrocarbyl units to amine units is 1:1 to 2.5:1, preferably 1.2:1 to 1.5:1. A number of acylated, nitrogen-containing compounds having a hydrocarbyl substituent of at least 10 carbon atoms and made by reacting a carboxylic acid acylating agent, for example an anhydride or ester, with an amino compound are known to those skilled in the art. In such compositions the acylating agent is linked to the amino compound through an imido, amido, amidine or acyloxy ammonium linkage. The hydrocarbyl substituent of 10 carbon atoms may be found either in the portion of the molecule derived from the carboxylic acid acylating agent, or in the portion derived from the amino compound, or in both. Preferably, however, it is found in the acylating agent portion. The acylating agent can vary from formic acid and its acylating derivatives to acylating agents having high molecular weight hydrocarbyl substituents of up to 50, 100 or 200 carbon atoms. The amino compounds can vary from ammonia itself to amines having hydrocarbyl substituents of up to about 30 carbon atoms.

A preferred class of acylated amino compounds are those made by reacting an acylating agent having a hydrocarbyl substituent of at least 10 carbon atoms and a nitrogen compound characterized by the presence of at least one —NH— group. Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The amine also may be a hydroxyalkyl-substituted polyamine. The hydrocarbyl substituent in such acylating agents preferably averages at least about 30 or 50 and up to about 400 carbon atoms.

Illustrative of hydrocarbyl substituent groups containing at least 10 carbon atoms are n-decyl, n-dodecyl, tetrapropenyl, n-octadecyl, oleyl, chlorooctadecyl, triicontanyl, etc. Generally, the hydrocarbyl substituents are made from homo- or interpolymers (e.g. copolymers, terpolymers) of mono- and di-olefins having 2 to 10 carbon atoms, such as ethylene, propylene, 1-butene, isobutene, butadiene, isoprene, 1-hexene, 1-octene, etc. Typically, these olefins are 1-monoolefins. This substituent can also be derived from the halogenated (e.g. chlorinated or brominated) analogs of such homo- or interpolymers.

The hydrocarbyl substituents are predominantly saturated. The hydrocarbyl substituents are also predominantly aliphatic in nature, that is, they contain no more than one non-aliphatic moiety (cycloalkyl, cycloalkenyl or aromatic) group of 6 or less carbon atoms for every 10 carbon atoms in the substituent. Usually, however, the substituents contain no more than one such non-aliphatic group for every 50 carbon atoms, and in many cases, they contain no such non-aliphatic groups at all; that is, the typically substituents are purely aliphatic. Typically, these purely aliphatic substituents are alkyl or alkenyl groups.

A preferred source of the substituents are poly(isobutene)s obtained by polymerization of a $C_4$ refinery stream having a butene content of 35 to 75 weight percent and isobutene content of 30 to 60 weight percent in the presence of a Lewis acid catalyst such as aluminum trichloride or boron trifluoride. These polybutenes predominantly contain monomer repeating units of the configuration —$C(CH_3)_2CH_2$—.

The hydrocarbyl substituent is attached to the succinic acid moiety or derivative thereof via conventional means, for example the reaction between maleic anhydride and an unsaturated substituent precursor such as a polyalkene, as described for example in EP-B-0 451 380.

One procedure for preparing the substituted succinic acylating agents involves first chlorinating the polyalkene until there is an average of at least about one chloro group for each molecule of polyalkene. Chlorination involves merely contacting the polyalkene with chlorine gas until the desired amount of chlorine is incorporated into the chlorinated polyalkene. Chlorination is generally carried out at a temperature of about 75° C. to about 125° C. If desired, a diluent can be used in the chlorination procedure. Suitable diluents for this purpose include poly- and perchlorinated and/or fluorinated alkanes and benzenes.

The second step in the procedure is to react the chlorinated polyalkene with the maleic reactant at a temperature usually within the range of about 100° C. to about 200° C. The mole ratio of chlorinated polyalkene to maleic reactant is usually about 1:1. However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. It is normally desirable to provide an excess of maleic reactant; for example, an excess of about 5% to about 50%, for example 25% by weight. Unreacted excess maleic reactant may be stripped from the reaction product, usually under vacuum.

Another procedure for preparing substituted succinic acid acylating agents utilizes a process described in U.S. Pat. No. 3,912,764 and U.K. Pat. No. 1,440,219. According to that process, the polyalkene and the maleic reactant are first reacted by heating them together in a direct alkylation procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of polyalkene. The direct alkylation step is conducted at temperatures to 180° C. to 250° C. During the chlorine-introducing stage, a temperature of 160° C. to 225° C. is employed.

The attachment of the hydrocarbyl substituent to the succinic moiety may alternatively be achieved via the thermally-driven 'ene' reaction, in the absence of chlorine. Use of such a material is the acylating agent (i) leads to products having particular advantages; for example, chlorine-free products having excellent detergency and lubricity properties. In such products, the reactant (i) is preferably formed from a polyalkene having at least 30% preferably 50% or more such as 75% of residual unsaturation in the form of terminal, e.g. vinylidene, double bonds.

The polyamines suitable in this invention are those comprising amino nitrogens linked by alkylene bridges, which amino nitrogens may be primary, secondary and/or tertiary in nature. The polyamines may be straight chain, wherein all the amino groups will be primary or secondary groups, or may contain cyclic or branched regions or both, in which case tertiary amino groups may also be present. The alkylene groups are preferably ethylene or propylene groups, with ethylene being preferred. Such materials may be prepared from the polymerization of lower alkylene diamines such as ethylene diamine, a mixture of polyamines being obtained, or via the reaction of dichloroethane and ammonia.

Specific examples of the polyalkylene polyamines (1) are ethylene diamine, tetra(ethylene)pentamine, tri-(trimethylene)tetramine, and 1,2-propylene diamine. Specific examples of hydroxyalkyl-substituted polyamines include N-(2-hydroxyethyl) ethylene diamine, N,N$^1$-bis-(2-hydroxyethyl) ethylene diamine, N-(3-hydroxybutyl) tetramethylene diamine, etc. Specific examples of the heterocyclic-substituted polyamines (2) are N-2-aminoethyl piperazine, N-2 and N-3 amino propyl morpholine, N-3-(dimethylamino) propyl piperazine, 2-heptyl-3-(2-aminopropyl) imidazoline, 1,4-bis (2-aminoethyl) piperazine, 1-(2-hydroxy ethyl) piperazine, and 2-heptadecyl-1-(2-hydroxyethyl)-imidazoline, etc. Specific examples of the aromatic polyamines (3) are the various isomeric phenylene diamines, the various isomeric naphthalene diamines, etc.

Many patents have described useful acylated nitrogen compounds including U.S. Pat. No. 3,172,892; 3,219,666; 3,272,746; 3,310,492; 3,341,542; 3,444,170; 3,455,831; 3,455,832; 3,576,743; 3,630,904; 3,632,511; 3,804,763 and 4,234,435, and including European patent applications EP 0 336 664 and EP 0 263 703. A typical and preferred compound of this class is that made by reacting a poly(isobutylene)-substituted succinic anhydride acylating agent (e.g. anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene groups. In view of the extensive disclosure of this type of acylated amino compound, further discussion of their nature and method of preparation is not needed here. The above-noted US patents are utilized for their disclosure of acylated amino compounds and their method of preparation.

Preferred materials also include those made from amine mixtures comprising polyamines having seven and eight, and optionally nine, nitrogen atoms per molecule (so-called 'heavy' polyamines).

More preferably, the polyamine mixture comprises at least 45% and preferably 50% by weight of polyamines having seven nitrogen atoms per molecule, based on the total weight of polyamines.

The polyamine component (ii) may be defined by the average number of nitrogen atoms per molecule of the component (ii), which may preferably be in the range of 4 to 8.5, more preferably 6.8 to 8, especially 6.8 to 7.5 nitrogens per molecule. The number of nitrogens appears to influence the ability of the product to provide deposit control.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 0.1:1, such as 1:1. Typical of the monocarboxylic acid are formic acid, acetic acid, dodecanoic acid, butanoic acid, oleic acid, stearic acid, the commercial mixture of stearic acid isomers known as isosteric acid, tolyl acid, etc. Such materials are more fully described in U.S. Pat. Nos. 3,216,936 and 3,250,715.

Still another type of acylated nitrogen compound is the product of the reaction of a fatty monocarboxylic acid of about 12-30 carbon atoms and the afore-described alkylene amines, typically, ethylene, propylene or trimethylene polyamines containing 2 to 8 amino groups and mixtures thereof. The fatty mono-carboxylic acids are generally mixtures of straight and branched chain fatty carboxylic acids containing 12-30 carbon atoms. A widely used type of acylating nitrogen compound is made by reacting the afore-described alkylene polyamines with a mixture of fatty acids having from 5 to about 30 mole percent straight chain acid and about 70 to about 95 mole percent branched chain fatty acids. Among the commercially available mixtures are those known widely in the trade as isostearic acid. These mixtures are produced as by-product from the dimerization of unsaturated fatty acids as described in U.S. Pat. Nos. 2,812,342 and 3,260,671.

The preferred acylated nitrogen ashless detergent compounds are those made by reacting a poly (isobutene) substituted succinic anhydride acylating agent with mixtures of ethylene polyamines as hereinbefore described, wherein the polyisobutene has a Mn of about 400-2500, preferably 700-400, such as about 950.

(h) Lubricity Enhancer

Suitable lubricity enhancers include monohydric or polyhydric alcohol esters of $C_2$-$C_{50}$ carboxylic acids such as glycerol monooleate, esters of polybasic acids with $C_1$-$C_5$ monohydric alcohols, esters of dimerized carboxylic acids, reaction products of polycarboxylic acids and epoxides such as 1,2-epoxyethane and 1,2-epoxypropane and lubricity additives derived from fatty acids such as vegetable oil fatty acid methyl esters, as well as fatty acid amides of monoethanolamine and diethanolamine.

Advantageously the carboxylic acid maybe a polycarboxylic acid, preferably a dicarboxylic acid, preferably having between 9 and 42 carbon atoms, more especially between 12 and 42 carbon atoms, between the carbonyl groups, the alcohol advantageously having from 2 to 8 carbon atoms and from 2 to 6 hydroxy groups.

Advantageously, the ester has a molecular weight of at most 950, preferably of at most 800. The dicarboxylic acid may be saturated or unsaturated; advantageously it is an optionally hydrogenated "dimer" acid, preferably a dimer of oleic or, especially linoleic acid, or a mixture thereof. The alcohol is advantageously a glycol, more advantageously an alkane or oxaalkane glycol, preferably ethylene glycol. The ester may be a partial ester of the polyhydric alcohol and may contain a free hydroxy group or groups; however, advantageously any acid groups not esterified by the glycol are capped by a monohydric alcohol, for example, methanol. It is within the scope of the invention to use two or more lubricity enhancers.

Another preferred lubricity enhancer is a mixture of esters comprising:

(i) an ester of an unsaturated monocarboxylic acid and a polyhydric alcohol, and (ii) an ester of an unsaturated monocarboxylic acid and a polyhydric alcohol having at least three hydroxy groups, the esters (i) and (ii) being different.

The term 'polyhydric alcohol' is used herein to describe a compound having more than one hydroxy-group. It is preferred that (i) is the ester of a polyhydric alcohol having at least three hydroxy groups.

Examples of polyhydric alcohols having at least three hydroxy groups are those having 3 to 10, preferably 3 to 6, more preferably 3 to 4 hydroxy groups and having 2 to 90, preferably 2 to 30, more preferably 2 to 12 and most preferably 3 to 4 carbon atoms in the molecule. Such alcohols may be aliphatic, saturated or unsaturated, and straight chain or branched, or cyclic derivatives thereof.

Advantageously, both (i) and (ii) are esters of trihydric alcohols, especially glycerol or trimethylol propane. Other suitable polyhydric alcohols include pentaerythritol, sorbitol, mannitol, inositol, glucose and fructose.

The unsaturated monocarboxylic acids from which the esters are derived may have an alkenyl, cyclo alkenyl or aromatic hydrocarbyl group attached to the carboxylic acid group. The hydrocarbyl group may be interrupted by one or more hetero atoms such as O or N.

It is preferred that (i) and (ii) are both esters of alkenyl monocarboxylic acids, the alkenyl groups preferably having 10 to 36, for example 10 to 22, more preferably 18-22, especially 18 to 20 carbon atoms. The alkenyl group may be mono- or poly-unsaturated. It is particularly preferred that (i) is an ester of a mono-unsaturated alkenyl monocarboxylic acid, and that (ii) is an ester of a poly-unsaturated alkenyl monocarboxylic acid. The poly-unsaturated acid is preferably di- or tri-unsaturated. Such acids may be derived from natural materials, for example vegetable or animal extracts. Examples of naturally derived acids include tall oil fatty acid with differing levels of rosin acid, and acids obtainable from rapeseed oil, coriander oil, soyabean oil, cottonseed oil, sunflower oil, castor oil, olive oil, peanut oil, maize oil, almond oil, palm kernel oil, coconut oil, mustard seed oil, beef tallow, hoof oil and fish oils. Recycled oils may also be used.

Especially-preferred mono-unsaturated acids are oleic and elaidic acid. Especially preferred poly-unsaturated acids are linoleic and linolenic acid.

The esters may be partial or complete esters, i.e. some or all of the hydroxy groups of each polyhydric alcohol may be esterified. It is preferred that at least one of (i) or (ii) is a partial ester, particularly a monoester. Especially good performance is obtained where (i) and (ii) are both monoesters.

The esters may be prepared by methods well known in the art, for example by condensation reactions. If desired, the alcohols may be reacted with acid derivatives such as anhydrides or acyl chlorides in order to facilitate the reaction and improve yields.

The esters (i) and (ii) may be separately prepared and then mixed together, or may be prepared together from a mixture of starting materials. In particular, commercially-available mixtures of suitable acids may be reacted with a selected alcohol such as glycerol to form a mixed ester product. Particularly-preferred commercial acid mixtures are those comprising oleic and linoleic acids. In such mixtures, minor proportions of other acids, or acid polymerisation products, may be present but these should not exceed 15%, more preferably not more than 10%, and most preferably not more than 5% by weight of the total acid mixture.

Similarly, mixtures of esters may be prepared by reacting a single acid with a mixture of alcohols.

A highly-preferred ester mixture is that obtained by reacting a mixture of oleic and linoleic acids with glycerol, the mixture comprising predominantly (i) glycerol monooleate and (ii) glycerol monolinoleate, preferably in approximately equal proportions by weight.

Further examples are lubricity enhancers prepared by combining the aforesaid esters of $C_2$-$C_{50}$ carboxylic acids with an ashless dispersant comprising an acylated nitrogen compound having a hydrocarbyl substituent of at least 10 carbon atoms made by reacting an acylating agent with an amino compound, such as the reaction products of polyisobutenyl ($C_{80}$-$C_{500}$) succinic anhydride with ethylene polyamines having 3 to 7 amino nitrogen atoms.

As an alternative to the above described esters, or in combination therewith, the lubricity enhancer may comprise one or more carboxylic acids of the types disclosed in relation to the ester lubricity enhancers. Such acids may be mono- or polycarboxylic, saturated or unsaturated, straight or branched chain and may be generalised by the formula $R^{11}(COOH)_x$ where x is 1-4 and $R^{11}$ is a $C_2$ to $C_{50}$ hydrocarbyl. Examples are capric, lauric, myristic, palmitic, oleic, elaidic, palmitoleic, petaoselic, ricinoleic, linoleic, linolenic, eicosanic, tall oil fatty, rape seed oil, sunflower oil and dehydrated castor oil fatty acids, and rosin acids and isomers and mixtures thereof. The polycarboxylic acid may be a dimer acid such as that formed by dimerization of unsaturated fatty acids such as linoleic or oleic acid Another example of lubricity enhancer chemistry are compounds of the following formula, described in WO 97/45507 and WO 02/02720:

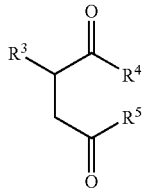

Where $R^3$ is a $C_{10-32}$ alkenyl group and $R^4$ and $R^5$ are $(—OCH_2CH_2)_nOH$, $(—OCH_2CHCH_3)_nOH$, or $—OCH_2CHOHCH_2OH$ in which n=1-10.

Other lubricity additives are combinations of the aforesaid esters with ethylene-unsaturated ester copolymers having, in addition to units derived from ethylene, units of the formula $$—CR^6R^7—CHR^8—$$

wherein $R^6$ represents hydrogen or methyl; $R^7$ represents $COOR^9$, wherein $R^9$ represents an alkyl group having from 1 to 9 carbon atoms which is straight chain or, if it contains 2 or more carbon atoms, branched, or $R^7$ represents $OOCR^{10}$, wherein $R^{10}$ represents $R^9$ or H; and $R^8$ represents H or $COOR^9$. Examples are ethylene-vinyl acetate and ethylene-vinyl propionate and other copolymers where there is present 5-40% of the vinyl ester Other lubricity enhancers are hydroxy amines of the formula:

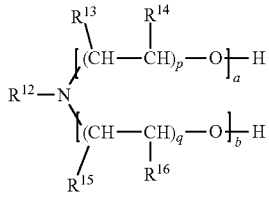

where $R^{12}$ is an alkenyl radical having one or more double bonds or an alkyl radical and containing from 4 to 50 carbon atoms, or a radical of the formula:

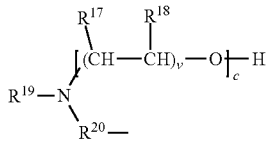

where each of $R^{13}$, $R^{14}$, $R^{15}$, $R^{16}$, $R^{17}$ and $R^{18}$ is independently hydrogen or a lower alkyl radical; $R^{19}$ is an alkenyl radical having one or more double bonds or an alkyl radical and containing from 4 to 50 carbon atoms; $R^{20}$ is an alkylene radical containing from 2 to 35, e.g. 2 to 6, carbon atoms; each of p, q and v is an integer between 1 and 4; and each of a, b and c may be 0, providing that at least one of a, b or c is an integer between 1 and 75.

Other lubricity additives are ester, amine and amine salt derivatives of salicylic acid and alkylated salicylic acids.

Some lubricity enhancers are described for example, in EP 0807 676, WO94/17160 and WO99/15607.

(i) Polyalkenylthiophosphonic Acid Derivatives

The combination of HBFC with derivatives of polyalkenylthiophosphonic acids has been found to act synergistically to enhance fuel conductivity. The materials of interest are described for example in U.S. Pat. No. 5,621,154 and are preferably esters formed by reacting a polyalkenylthiophosphonic acid with an alcohol. Particularly preferred is the ester formed by reaction with pentaerythritol.

Other materials which have been found to provide a synergistic effect on fuel conductivity when used in combination with HBFC include certain commercially available demulsifiers, examples of which include Breaxit 115 and Tolad 9308.

EXAMPLES

The invention will now be particularly described, by way of example only, with reference to the following drawings in which.

PREPARATION OF HBFC COMPOUNDS

Figure 1:
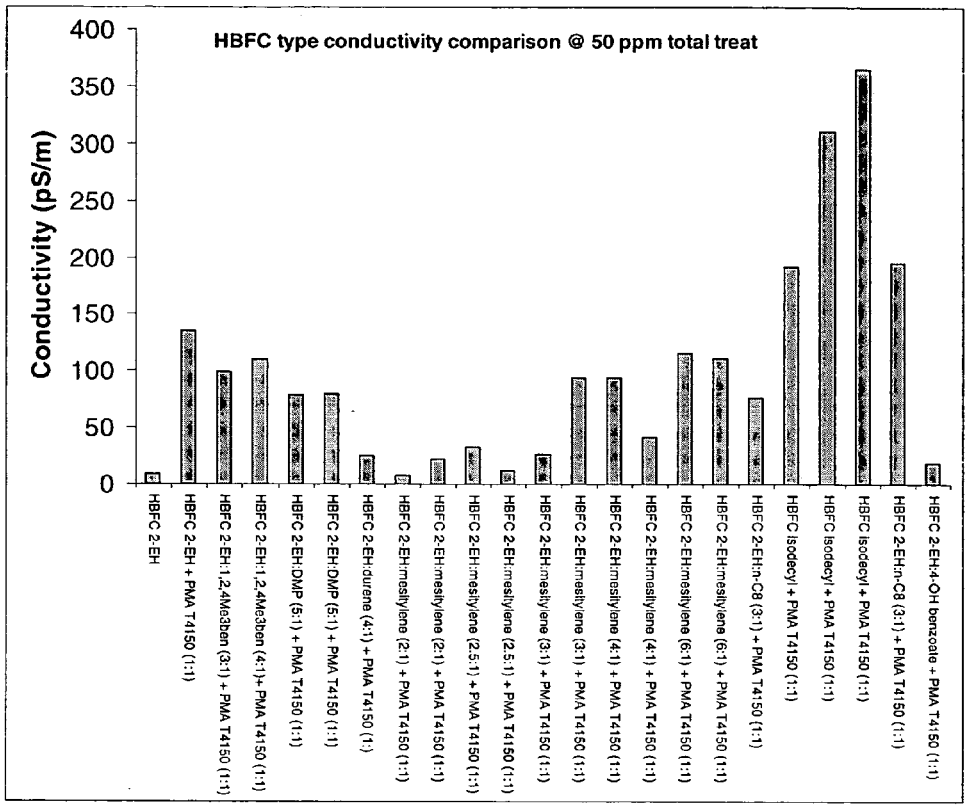
FIG. 1 is a bar chart showing the effect on fuel conductivity of various HBFC compounds together with a nitrogen-containing polymethacrylate polymer to a low sulphur diesel fuel.

The following synthetic schemes relate to the preparation of some HBFC compounds which may be used in the present invention. It will be understood that these examples are given merely to illustrate possible preparative routes and as such are not intended to be limiting in any way. The skilled man will be aware of other synthetic methods and will be able to extend the teachings to the preparation of other compounds, which whilst not explicitly described herein, will nonetheless be suitable for use in the present invention.

Isodecyl HBFC

A mixture of p-hydroxybenzoic acid (1110 g), isodecanol (1397 g), Exxsol D60 (670 g, a non-aromatic, hydrocarbon solvent, bp ~200° C.), and p-toluenesulphonic acid (43 g) was heated to 160° C. over 1.5 hours, slowly reducing the pressure to 200 mbar. The water produced in the reaction was continuously removed using a Dean and Stark apparatus. Heating was continued for a total of 4.5 hours and the vacuum released. The reaction mixture was then cooled to ~80° C. and then to it was added 95% paraformaldehyde (216 g). The mixture was kept at 80-85° C. for 2 hours and then heated to 135° C. The pressure was gradually reduced to ~120 mbar and the water produced in the reaction was continuously removed using a Dean and Stark apparatus. Heating was continued for 5 hours and then Solvesso 150 (1500 g) was added to dilute the mixture and give a product having a Mn of 1800 and a Mw of 2400.

2-Ethylhexyl/n-Octyl (3:1) HBFC

A mixture of p-hydroxybenzoic acid (1109 g), 2-ethylhexanol (862 g), n-octanol (288 g), p-toluenesulphonic acid (43 g) and Exxsol D60 (670 g) heated to ~157° C. over ~30 mins, slowly reducing the pressure to ~240 mbar. Water produced in the reaction was continuously removed using a Dean and Stark apparatus. Heating was continued for a total of 3.5 hours then the vacuum was released and the mixture cooled to ~80° C.

95% Paraformaldehyde (228 g) was then added and the mixture kept at 80-85° C. for 2 hours followed by an hour at 95-100° C. It was then heated to 135° C. and the pressure was gradually reduced to ~120 mbar. Water produced in the reaction was continuously removed using a Dean and Stark apparatus. Heating was continued for a total of 5 hours. Solvesso 150 (900 g) and 2,4-di-t-butylphenol (500 g) were then added to the mixture as diluents to give the final product, which had a Mn of 1150 and a Mw of 1400.

2-Ethylhexyl HBFC (i) A mixture of p-hydroxybenzoic acid (213 g), 2-ethylhexanol (220 g), xylene (200 ml) and p-toluenesulphonic acid (2 g) was refluxed at ~155° C. for 10 hours and the water produced in the reaction was continuously removed using a Dean and Stark apparatus. The mixture was then evaporated under reduced pressure to give 393 g of product, i.e. 2-ethylhexyl p-hydroxybenzoate.

(ii) A mixture of the above product (39.7 g), 95% paraformaldehyde (4.55 g), p-toluenesulphonic acid (0.35 g) and heptane (60 ml) was heated at 80-85° C. for 2 hours. It was then refluxed at ~115° C. for 9 hours and the water produced in the reaction was continuously removed using a Dean and Stark apparatus. Toluene (60 ml) was then added as a diluent to give the product, which had a Mn of 1300 and a Mw of 1750.

2-Ethylhexyl HBFC, Incorporating Xylene

A mixture consisting of 2-ethylhexyl p-hydroxybenzoate (41.1 g, as produced in the above reaction), xylene (8.7 g), 95% paraformaldehyde (5.2 g), p-toluenesulphonic acid (0.4 g) and octane (50 m) was heated to 80-85° C. for 2 hours then refluxed at ~135° C. for 4.5 hours, continuously removing the water produced in the reaction using a Dean and Stark apparatus. Toluene (40 ml) was then added to dilute the product, which had a Mn of 1000 and a Mw of 1300.

2-Ethylhexyl HBFC, Incorporating 2,4-di-t-butylphenol

A mixture of 2-ethylhexyl p-hydroxybenzoate (37.3 g, as produced in the above reaction), 2,4-di-t-butylphenol (7.7 g), 95% paraformaldehyde (5.65 g), 0.45 g p-toluenesulphonic acid and octane (25 g) was heated to 80-85° C. for 2 hours then refluxed at ~135° C. for 5 hours. The water produced in the reaction was continuously removed using a Dean and Stark apparatus. Solvesso 150 (27 g) was then added to dilute the product, which had a Mn of 1250 and a Mw of 2000.

Conductivity Data

Conductivity testing of fuel specimens was carried out using an Emcee™ Digital Conductivity Meter (Model 1152), which has a calibrated range of 0-390 $pSm^{-1}$. The instrument is self calibrating and zeroing and was used in accordance with the user manual. All conductivity measurements were performed at room temperature on 250-300 ml of fuel in a 300 ml tall glass beaker. The conductivity measurements were made within 2 hours of placing the fuel into the beaker, dosing it with the respective additives and mixing.

All conductivity data are presented in units of $pSm^{-1}$.

The data in Table 1 show the conductivity of a diesel fuel incorporating 20, 50 and 100 ppm of four samples of HBFC materials. In all cases, significant improvement in conductivity is observed over the base fuel alone. In the table, 2-ethylhexyl/n-octyl HBFC represents the 2-ethylhexyl/n-octyl (3:1) mixed ester species and the use of a species in brackets e.g. HBFC (mesitylene) indicates that the HBFC was copolymerised with mesitylene.

TABLE 1

| | 0 ppm | 20 ppm | 50 ppm | 100 ppm |
|---|---|---|---|---|
| Base fuel 1 | 8 | | | |
| 2-ethylhexyl/n-octyl (3:1)HBFC | | 70 | 81 | 96 |
| isodecyl HBFC | | 106 | 123 | 183 |
| 2-ethylhexyl HBFC (mesitylene) | | 43 | 66 | 80 |
| 2-ethylhexyl HBFC (2,4-dimethylphenol) | | 28 | 35 | 42 |

The data presented in FIG. 1 illustrate the effect of adding a high molecular weight polymethacrylate containing ca. 4 wt % of dimethylaminoethylmetacrylate monomers (PMA T4150) to HBFC compounds. Base fuel 2 was used (see Table 4). Each data point label describes the nature of the HBFC tested. For example, HBFC 2-EH refers to a 2-ethylhexyl ester species; and HBFC 2-EH:mesitylene (3:1) refers to a compound where the 2-ethylhexyl ester species is copolymerised with mesitylene, the ratio of the ester to the mesitylene being 3:1 All compounds were added to a low sulphur diesel fuel at a total treat rate of 50 wppm, the ratio of the HBFC to PMA being 1:1 by weight. The conductivity of the base fuel was 2 $pSm^{-1}$. High conductivity was observed for all of the HBFC species, with the maximum conductivity being observed for those compositions containing isodecyl ester HBFC species. The conductivity of the base fuel treated with 50 wppm of the PMA alone was ca. 5 $pSm^{-1}$ The synergistic effect of the PMA species is clearly demonstrated. Taking one example, the conductivity of the fuel sample treated with 50 wppm of HBFC isodecyl was 68 $pSm^{-1}$ which compares with 365 $pSm^{-1}$ for the same HBFC used in combination with the PMA. This is five times greater than the value which would be predicted from a simple summation of the individual effects of the two additive species.

Figure 2:
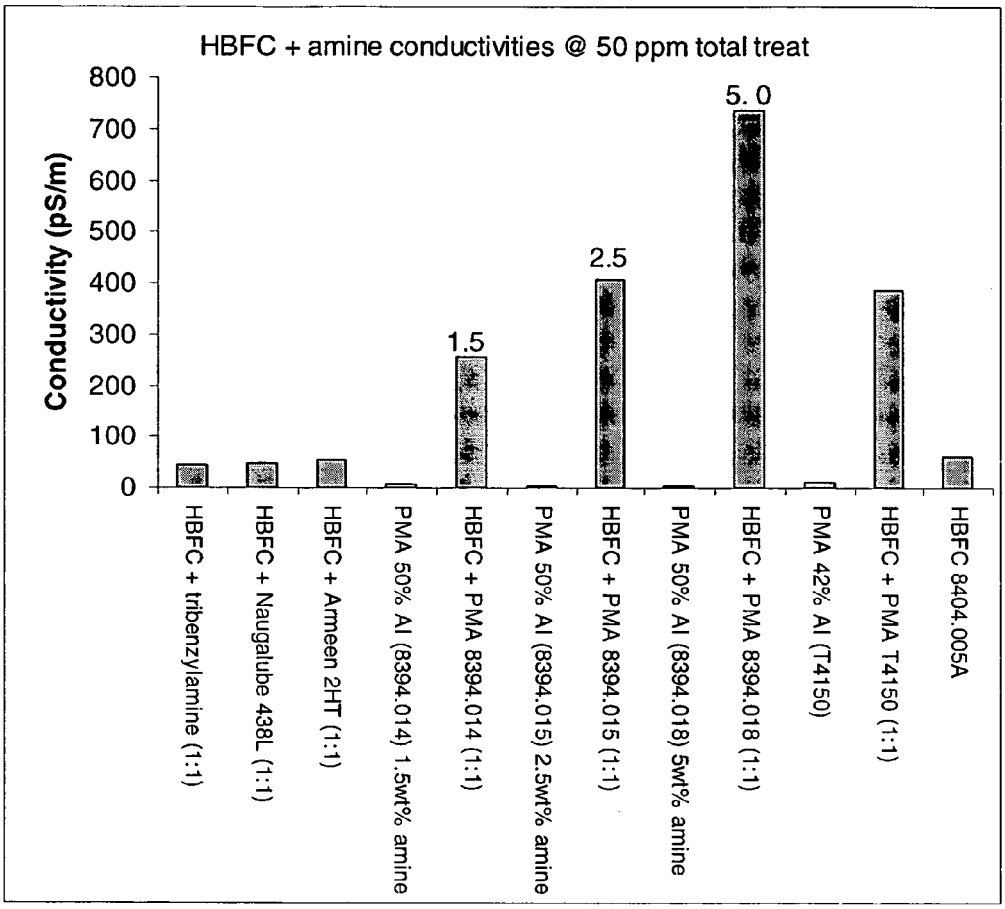
FIG. 2 is a bar chart showing the effect of the nitrogen content of the nitrogen-containing polymethacrylate polymer of FIG. 1.

Investigation into the mechanism of the synergistic interaction between HBFC and other components was performed. Base fuel 2 was used. The data in FIG. 2 show that HBFC is not synergistic with all amine species. No synergy is observed with tribenzyl amine (a tertiary amine), Naugalube 438L (a secondary aryl amine) nor Armeen 2C (a secondary alkyl amine). However, with the polymethacrylates, there is an almost linear response between conductivity synergy and the amine content of the polymethacrylate. The polymethacrylates 8394.014, 015 and 018 are isodecyl methacrylate dimethylaminoethylmethacrylate copolymers of ~20,000 molecular weight where the weight % content of the aminic monomer is shown above each bar in FIG. 2. The result for T4150 indicates that molecular weight has little impact (T4150 is ~300,000 molecular weight). It should be noted that the polymethacrylate materials were added as 50% dilutions in Solvesso 150 (42% for T4150). This means that on an active ingredient (AI) basis, a 1:1 mixture is in fact a 2:1 HBFC:PMA mixture.

Figure 3:
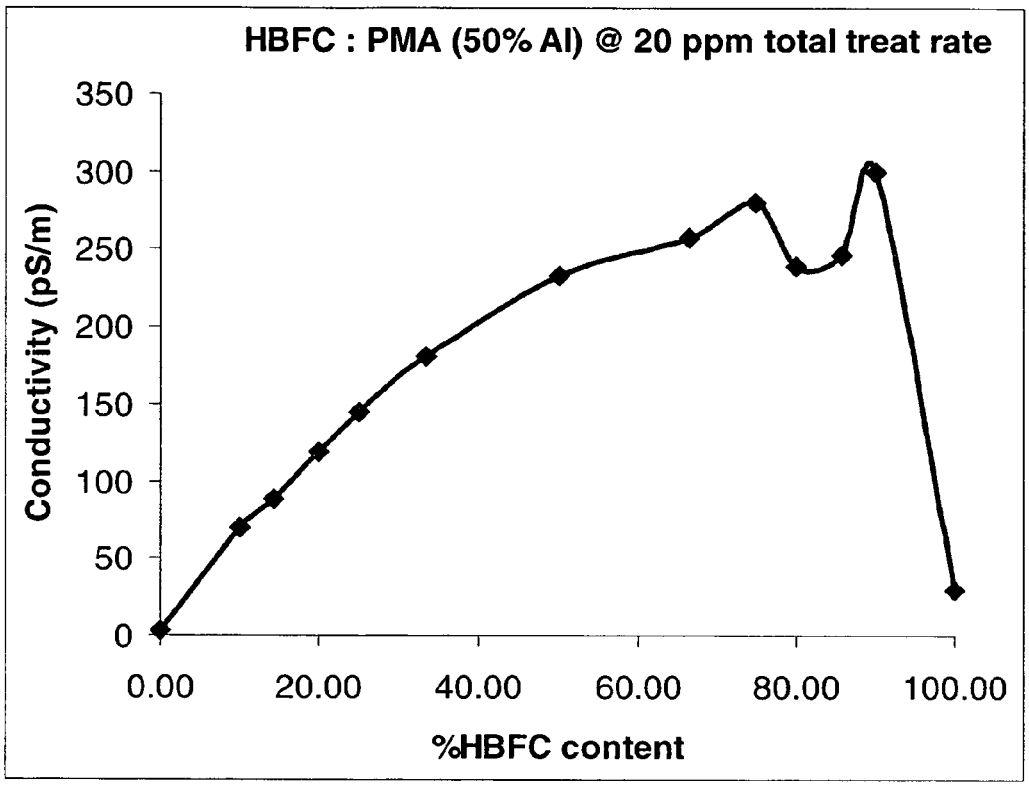
FIG. 3 is a graph showing the effect on fuel conductivity of varying the relative amounts of HBFC and polymethacrylate polymer in the additive composition; and, FIG. 4 is a bar chart comparing the conductivity of fuel with additive compositions comprising HBFC and a nitrogen-containing polymethacrylate polymer, where the polymethacrylate is based on either an isodecyl or 2-ethylhexyl backbone.

The effect of composition was further investigated with HBFC and polymethacrylate 8394.018. Base fuel 2 was used. The data presented in FIG. 3 show that with functional polymethacrylates below a 1:1 ratio (2:1 based on AI), the conductivity increases almost linearly. Above this value, the conductivity peaks. It is noteworthy that compositions which have a large proportion of the PMA species (e.g. 1:9, or 1:6 ratios) still show good conductivity, notwithstanding the very low inherent conductivity of the PMA species.

Figure 4:
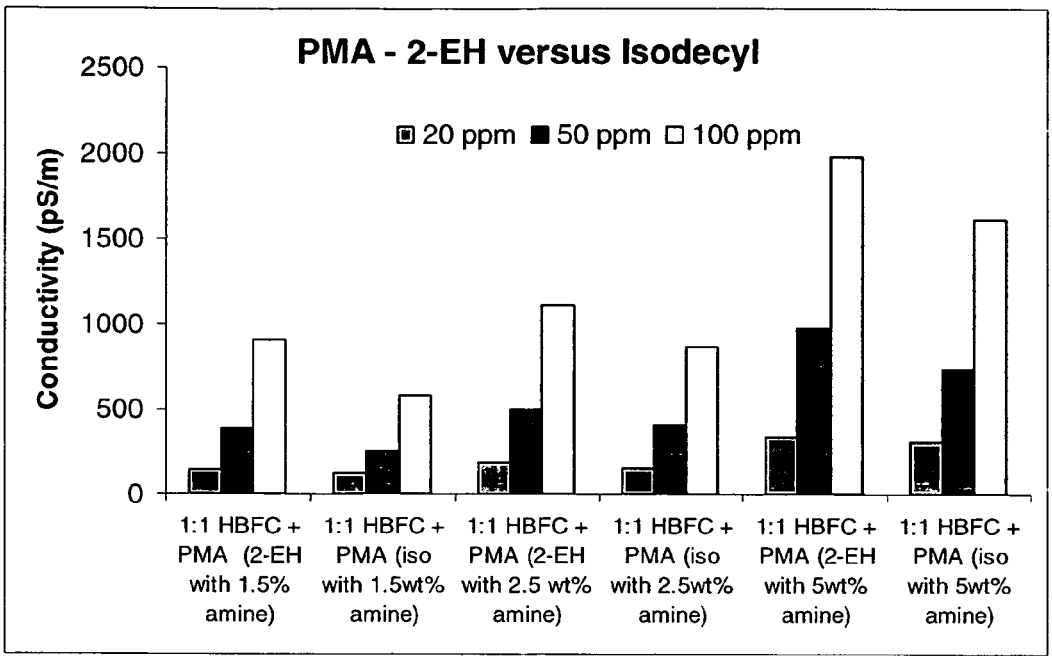

The effect of the polymethacrylate backbone was investigated. The results shown in FIG. 4 compare the polymethacrylates discussed in relation to FIG. 2 above, which were based on isodecyl methacrylate, with similar materials based on a 2-ethylhexyl methacrylate backbone. Base fuel 2 was used. As before, the amine content of the polymers was 1.5, 2.5 or 5 wt %. High conductivity was observed for all species and in all cases, higher values were obtained from the 2-ethylhexyl species with HBFC. Significant synergy was again observed, the inherent conductivity of the PMA species being at most 13 $pSm^{-1}$.

A wide range of other components were tested for synergistic conductivity with HBFC. The results are presented in Table 2 below.

TABLE 2

| | 0 ppm | 50 ppm | 50 ppm 1:9 ratio HBFC to Additive | 50 ppm 1:1 ratio HBFC to Additive | 50 ppm 9:1 ratio HBFC to Additive |
|---|---|---|---|---|---|
| Base fuel 2 | 2 | | | | |
| Isodecyl HBFC | | 123 | | | |
| Breaxit 115 | | 23 | 253 | 135 | 73 |
| Add D1 | | 39 | 78 | 147 | 127 |
| Add C1 | | 6 | 122 | 181 | 122 |
| Add C2 | | 6 | 128 | 190 | 137 |
| Add C3 | | 5 | 127 | 188 | 129 |
| Add C4 | | 4 | 64 | 103 | 91 |
| Add C5 | | 4 | 57 | 113 | 95 |
| Add C6 | | 4 | 129 | 146 | 63 |
| Add D2 | | 200 | 227 | 277 | 232 |
| Add C7 | | 4 | 139 | 157 | 57 |
| T-9308 | | 10 | 74 | 134 | 72 |

Significant synergy was observed for Breaxit 115 (a commercial demulsifier), D1 (mono-PIBSA-PAM detergent), Cl (di-n-dodecyl fumarate/vinyl acetate copolymer), C2 (di-n-dodecyl tetradecyl fumarate/vinyl acetate copolymer), C3 ($C_1$-4 dialkyl fumarate/vinyl acetate copolymer), C6 (polar nitrogen compound), C7 (polar nitrogen compound) and T-9308 (a commercial demulsifier). D2 (PIBSA-heavy PAM detergent) has high intrinsic conductivity and HBFC compliments this giving a slight boost at the 1:1 ratio, but demonstrates similar conductivity even at the 9:1 ratio where only a small proportion of the D2 is present. C4 (di-n-tetradecyl/pentadecyl fumarate vinyl acetate copolymer) and C5 (80% solution in oil of C4) also show synergies especially when little HBFC is present.

The results given in Table 3 below show that a commercial pentaerythritol ester of a polyalkylenethiophosphonic acid (Additive E1) when combined with HBFC acts synergistically to improve the conductivity of a fuel. E1 was dosed into the fuel at 250 ppm and increasing amounts of HBFC added. A very rapid increase in conductivity was observed at low levels of HBFC addition.

TABLE 3

| Treat rate of HBFC (ppm) | Conductivity with 250 ppm of E1 (pS/m) |
|---|---|
| 0 | 193 |
| 2.5 | 933 |

TABLE 3-continued

| Treat rate of HBFC (ppm) | Conductivity with 250 ppm of E1 (pS/m) |
|---|---|
| 5.0 | 1104 |
| 7.5 | 1165 |
| 10.0 | 1206 |
| 15.0 | 1279 |

Table 4 gives details of the fuels used in the experiments.

TABLE 4

| Test | Units | Base fuel 1 Result | Base fuel 2 Result |
|---|---|---|---|
| Density @ 15° C. | kg/l | 833.9 | 829.4 |
| Distillation | | | |
| IBP | ° C. | 183.7 | 199.2 |
| 10% | | 224.3 | 224.1 |
| 50% | | 281.0 | 264.0 |
| 90% | | 339.6 | 318.6 |
| FBP | | 368.9 | 351.7 |
| RESIDUE | vol % | | 1.0 |
| LOSS | vol % | | 1.0 |
| Total sulphur | % m/m | 300 | <0.001 |
| CP | | 1 | −6.1 |
| CFPP | | | −13.0 |

The invention claimed is:

1. A method for improving the conductivity of a fuel oil composition, which method comprises blending a fuel oil with an additive composition, wherein the additive composition comprises a polymeric condensation product formed by a reaction of an aliphatic aldehyde or ketone, or a reactive equivalent, with at least one ester of p-hydroxybenzoic acid selected from the group consisting of (i) a straight or branched chain C1-C7 alkyl ester of p-hydroxybenzoic acid; (ii) a branched chain C8-C16 alkyl ester of p-hydroxybenzoic acid, and; (iii) a mixture of long chain C8-C18 alkyl esters of p-hydroxybenzoic acid, at least one of said alkyls being branched.

2. The method of claim 1, wherein the polymeric condensation product has a number average molecular weight (Mn) of 500-5000.

3. The method of claim 1, wherein the alkyl in (i) is ethyl or n-butyl.

4. The method of claim 1, wherein the branched alkyl in (ii) or (iii) is 2-ethylhexyl or isodecyl.

5. The method of claim 1, wherein the polymeric condensation product also comprises a reactive aromatic comonomer.

6. The method of claim 1, wherein the aldehyde or ketone or reactive equivalent has 1 to 8 carbon atoms.

7. The method of claim 1, wherein the polymeric condensation product is formed by the reaction with formaldehyde.

8. The method of claim 1, wherein the additive composition also comprises a co-additive which is at least one of:

(a) an ethylene polymer,
(b) a comb polymer,
(c) a polar nitrogen compound,
(d) a polyoxyalkylene compound,
(e) a di-block hydrocarbon polymer,
(f) a copolymer, terpolymer or polymer of acrylic acid or methacrylic acid or a derivative thereof,
(g) a nitrogen-containing ashless detergent,
(h) lubricity enhancer, or
(i) polyalkenylthiophosphonic acid derivatives.

9. A method for improving the conductivity of a fuel oil composition, which method comprises blending a fuel oil with an additive composition, wherein the additive composition comprises (a) from 0.1 to 500 ppm of a polymeric condensation product formed by a reaction of an aliphatic aldehyde or ketone, or a reactive equivalent, with at least one ester of p-hydroxybenzoic acid selected from the group consisting of (i) a straight or branched chain C1-C7 alkyl ester of p-hydroxybenzoic acid; (ii) a branched chain C8-C16 alkyl ester of p-hydroxybenzoic acid, and (iii) a mixture of long chain C8-C18 alkyl esters of p-hydroxybenzoic acid, at least one of said alkyls being branched; and (b) from 0.1 to 500 ppm of a co-additive comprising a copolymer or terpolymer of methacrylic or acrylic acid esters of alcohols having about 1 to 40 carbon atoms, wherein at least one of the methacrylic or acrylic acid ester monomers is a nitrogen-containing, amine-containing or amide containing derivative.

* * * * *